US009021656B2

(12) United States Patent
Brunnmayr

(10) Patent No.: US 9,021,656 B2
(45) Date of Patent: May 5, 2015

(54) FURNITURE DAMPER

(71) Applicant: Julius Blum GmbH, Hochst (AT)

(72) Inventor: Harald Brunnmayr, Horbranz (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/775,399

(22) Filed: Feb. 25, 2013

(65) Prior Publication Data

US 2013/0160242 A1 Jun. 27, 2013

Related U.S. Application Data

(63) Continuation of application No. PCT/AT2011/000353, filed on Aug. 24, 2011.

(30) Foreign Application Priority Data

Aug. 27, 2010 (AT) ..... A 1438/2010

(51) Int. Cl.
*E05F 5/02* (2006.01)
*E05F 5/00* (2006.01)
*E05F 5/10* (2006.01)

(52) U.S. Cl.
CPC ..... *E05F 5/006* (2013.01); *Y10T 16/625* (2015.01); *Y10T 16/5383* (2015.01); *E05F 5/02* (2013.01); *E05F 5/10* (2013.01); *E05Y 2201/21* (2013.01); *E05Y 2201/256* (2013.01); *E05Y 2201/264* (2013.01); *E05Y 2201/474* (2013.01)

(58) Field of Classification Search
USPC ..... 16/50, 54, 319, 352, 321, 327, 82, 83, 16/84, 85
See application file for complete search history.

(56) References Cited

U.S. PATENT DOCUMENTS 921,556 A * 5/1909 Moran ..... 16/85
1,034,115 A * 7/1912 Johnson ..... 267/226
1,704,217 A * 3/1929 Cerf Rosenthal et al. ..... 16/82
(Continued)

FOREIGN PATENT DOCUMENTS

AT 504 054 2/2008
AT 508 069 10/2010
(Continued)

OTHER PUBLICATIONS

International Search Report (ISR) issued Jan. 16, 2012 in International (PCT) Application No. PCT/AT2011/000353.
(Continued)

*Primary Examiner* — Jeffrey O Brien
(74) *Attorney, Agent, or Firm* — Wenderoth, Lind & Ponack, L.L.P.

(57) ABSTRACT

A furniture damper damps a movement of a movably mounted part of a piece of furniture or a movably mounted component of a furniture fitting. The damper includes a piston arranged in a fluid chamber, a damping action being carried out by a relative movement between the fluid chamber and the piston. A sealing device seals the fluid chamber, and the sealing device includes a first abutment element and a second abutment element that is movably mounted in relation to the first abutment element and designed to seal the fluid chamber. A spring is arranged between the first abutment element and the second abutment element, and the spring is compressible by the relative movement of the first abutment element and the second abutment element essentially up to the thickness of the cross-section of the spring.

16 Claims, 10 Drawing Sheets

(56) References Cited

U.S. PATENT DOCUMENTS

| | | | | |
|---|---|---|---|---|
| 2,074,008 | A * | 3/1937 | Wolf | 16/84 |
| 2,814,067 | A | 11/1957 | Bowden | |
| 3,365,189 | A | 1/1968 | Carlson | |
| 3,555,591 | A * | 1/1971 | Sogoian | 16/49 |
| 4,309,027 | A * | 1/1982 | Molders et al. | 267/124 |
| 4,455,708 | A * | 6/1984 | Saigne | 16/56 |
| 4,987,640 | A * | 1/1991 | Lin | 16/327 |
| 5,158,268 | A * | 10/1992 | Schnitzius et al. | 267/64.12 |
| 5,269,043 | A | 12/1993 | Yang | |
| 5,392,493 | A * | 2/1995 | Youngdale | 16/237 |
| 5,727,286 | A * | 3/1998 | Shen | 16/49 |
| 7,065,833 | B2 * | 6/2006 | Kropf | 16/286 |
| 7,134,168 | B1 * | 11/2006 | Qing | 16/80 |
| 7,966,696 | B2 * | 6/2011 | Krammer | 16/286 |
| 8,307,498 | B2 * | 11/2012 | Krammer | 16/83 |
| 2009/0119873 | A1 * | 5/2009 | Bassi | 16/84 |
| 2009/0119876 | A1 * | 5/2009 | Pecar et al. | 16/293 |
| 2009/0271946 | A1 * | 11/2009 | Lam et al. | 16/84 |
| 2009/0313789 | A1 * | 12/2009 | Lautenschlager | 16/343 |
| 2010/0212109 | A1 * | 8/2010 | Kim | 16/85 |
| 2011/0005032 | A1 | 1/2011 | Domenig et al. | |
| 2011/0019946 | A1 * | 1/2011 | Krammer | 384/20 |
| 2011/0067964 | A1 * | 3/2011 | Krammer et al. | 188/266 |
| 2013/0145580 | A1 * | 6/2013 | Brunnmayr | 16/277 |

FOREIGN PATENT DOCUMENTS

| | | |
|---|---|---|
| CN | 2695572 | 4/2005 |
| CN | 201507596 | 6/2010 |
| GB | 565630 | 11/1944 |
| JP | 2010-501755 | 1/2010 |
| WO | 2007/099100 | 9/2007 |
| WO | 2008/025592 | 3/2008 |
| WO | 2008/104009 | 9/2008 |
| WO | 2009/003458 | 1/2009 |
| WO | 2009/094272 | 7/2009 |

OTHER PUBLICATIONS

Austrian Patent Office Search Report (ASR) completed Mar. 4, 2011 in Austrian Patent Application No. A 1438/2010.

Chinese Office Action (OA) and Search Report (SR) issued Aug. 20, 2014 in corresponding Chinese Patent Application No. 201180041242.

Japanese Office Action (OA) issued Feb. 26, 2015 in parallel Japanese Patent Application No. 2013-525081.

* cited by examiner

FURNITURE DAMPER

BACKGROUND OF THE INVENTION

The invention concerns a furniture damper for damping a movement of a movably mounted furniture part or a movably mounted furniture fitting component of a furniture fitting, comprising a piston arranged in a fluid chamber, in which a damping action is performed by a relative movement between the fluid chamber and the piston. A sealing device is provided for sealing the fluid chamber, and the sealing device has a first abutment element and a second abutment element mounted movably relative to the first abutment element and adapted to seal the fluid chamber. A spring is arranged between the first abutment element and the second abutment element.

A furniture fitting having a furniture damper for damping a movably mounted furniture part, wherein a damping action is performed by a movement of a piston in a fluid chamber, is disclosed in WO 2009/003458. A movably mounted seal is acted upon by a spring which bears against the end plate of the fluid chamber. The spring serves in that case for guiding the movably mounted seal and is held by projections both against the seal and also against the end plate. In the intermediate region, the spring has a constant cross-section and occupies the entire interior of the housing in which the fluid chamber is arranged, to permit guidance for the seal, that is as stable as possible. The disadvantage of such a furniture fitting is that the nature of the spring and the projections take up a great deal of space and the range of movement of the seal is limited, whereby use is conceivable only for large furniture fittings where there is sufficient space. The advantages of a movably mounted seal, as are described in GB 565 630, cannot be enjoyed in that respect for every kind of furniture fittings.

SUMMARY OF THE INVENTION

Therefore, the object of the present invention is to provide a furniture damper of the general kind referred to in the opening part of this specification, which avoids the above-indicated disadvantages.

A furniture damper of the kind referred to in the opening part of this specification has the advantages that the abutment elements, which are mounted movably relative to each other, of the sealing device provide additional space for the damping stroke movement per se and as volume compensation in the course of a damping process when a relative movement takes place between the fluid chamber and the piston. In that case, a fluid is pressed for example as a damping liquid, for example silicone oil, through openings provided for the fluid, from a first region of the fluid chamber into a second region of the fluid chamber. The damping action occurs due to the resistance opposed to the fluid movement by the through openings, as in the case of a conventional fluid damper. The first and second abutment elements are acted upon by the spring disposed between the abutment elements so that, as a consequence of a relative movement of the abutment elements, compression or extension of the spring occurs and the abutment elements which are mounted movably relative to each other are returned to their starting position again.

In addition, the beginning and the end of the damping process can be initiated with less of a jerk and more gently, due to the spring-loaded sealing device. The characteristic curve of damping of the damper in itself, which is afforded by the damping force generated during a damping action, becomes smoother due to the movably mounted seal.

According to the invention, the spring can be compressed between the first and second abutment elements substantially to the cross-sectional thickness of the spring or the spring coils, whereby there is more damping travel with the same structural size. Alternatively, overall the structural size of the furniture damper is reduced in total in comparison with furniture dampers in the state of the art as, with a given additional compensating volume, due to the movably mounted sealing device, which volume is afforded by the extension and compression of the spring from its neutral position, the first and second abutment elements are compressible to a smaller mutual spacing by virtue of the nature according to the invention of the spring. As a result, the structural height of the sealing device turns out to be less than in the state of the art. The cross-sectional thickness of the spring or the spring coils is used to mean the cross-sectional diameter of the spring wire or the spring strip from which the spring or the spring coil is made.

In addition, it is possible for the volume of the compensating space which is additionally made available to be maximised by the spring according to the invention, without having to forego the advantages of a spring loading.

Further advantageous configurations of the invention are defined in the appendant claims.

In a particularly preferred embodiment of the invention, the spring is a conical spiral spring. A conical spiral spring is distinguished in that the projection of the spring coils on to a plane perpendicularly to the longitudinal axis of the spring represents a spiral. Compression of the conical spiral spring permits the spring coils to be arranged one within the other so that the compressed spring forms a spiral, whereby the lengthwise extent of the compressed spring substantially corresponds to the cross-sectional thickness of the spring or the spring coils. The individual coils of the conical spring have a spiral configuration and therefore increase in diameter. The coils of smaller diameter are pushed into the coils of larger diameter, when the spring is compressed. Upon compression of the spring to its cross-sectional thickness, all coils are pushed into the coil of largest diameter, which is arranged at the base of the conical spring. The cross-sectional thickness of the spring is given here by the cross-sectional diameter of the spring wire or spring strip of the largest coil diameter.

It is preferable that the spring has a central opening in which the piston or a piston rod connected to the piston is arranged so that in the mounted condition of the furniture damper, the spring coils are arranged around the piston or piston rod. In that way, the spring is guided during the movement of the first abutment element relative to the second abutment element, by the piston or the piston rod.

In a further embodiment of the invention, the first abutment element has a contact surface against which (in the mounted condition of the spring) a first end of the spring bears and the spring is thereby supported against the first abutment element. In that way, it is possible to dispense with projections in the abutment element for fixing the spring, which require a large amount of space. Additionally or alternatively, the second abutment element can have an abutment surface against which a second end of the spring bears in the mounted condition of the spring, whereby the spring is supported against the second abutment element. In that way, it is possible to dispense with projections on the second abutment element, that require a large amount of space and serve to mount the spring. The abutment elements are acted upon by the spring by way of the abutment surface or surfaces. A relative movement of the abutment elements with respect to each other is transmitted to the spring by way of the abutment surface or surfaces of the abutment elements.

During the damping process, the relative movement between the fluid chamber and the piston is transmitted to the abutment elements so that they are also moved relative to each other, whereby the spring is compressed between the abutment elements. In that respect, the spring has such a design that, as a consequence of a maximum damping stroke, the second and the first abutment elements assume a minimum spacing relative to each other, and the spring disposed between the abutment elements is compressed substantially to the cross-sectional thickness of the spring or spring coils. As a subsequent consequence, the spring stretches to its neutral position again and transmits that movement to the abutment elements so that they again assume a greater spacing from each other and are returned to their starting position.

In a further embodiment of the invention, the second abutment element has a sealing element which has sealing lips which (in the mounted condition) bear against the piston or a piston rod connected to the piston and additionally or alternatively against the wall of a housing surrounding the fluid chamber and thereby seal off the fluid chamber. In that case, the sealing integrity prevents the fluid in the fluid chamber from escaping therefrom. It is preferably provided in that respect that the fluid chamber is enclosed by a housing having an open end. The sealing integrity afforded by the sealing device, in particular by the sealing element with the sealing lips, closes off the fluid chamber in relation to the open end.

The invention further concerns a furniture hinge having a furniture damper as described above.

It is preferable in that respect that the furniture hinge has a carcass-side fitment portion and a hinge cup hingedly connected thereto for fixing furniture parts, and in the mounted position, the furniture damper is arranged substantially completely within the hinge cup. Instead, the furniture damper can be fitted from above into the hinge cup and can be arranged within the hinge cup. In that case, the fitment portion and the hinge cup can already be hingedly connected together. The furniture damper can be connected to the hinge cup by co-operating fixing means in that mounted position.

The space within a hinge cup is generally very small as hinge cups are arranged in side walls of furniture carcasses or in doors which close furniture carcasses. The advantage of furniture dampers arranged in hinge cups is that no space is occupied within the furniture carcass by the arrangement of the damper. However, very high demands are made on furniture dampers which are arranged in hinge cups, in regard to the small size of the components to be used. For that reason, a furniture damper according to the invention which has a spring between a first and a second abutment element, which spring can be compressed substantially to the cross-sectional thickness of the spring, is of particular advantage.

The invention further concerns a furniture damper for damping a movement of a movably mounted furniture part or a movably mounted furniture fitting component of a furniture fitting, comprising a piston arranged in a fluid chamber, wherein a damping action is performed by a relative movement between the fluid chamber and the piston. A sealing device is provided for sealing the fluid chamber, and the sealing device has a first abutment element and a second abutment element which is mounted movably relative to the first abutment element and which is adapted to seal the fluid chamber. The piston assumes a first end position at the end of the damping stroke relative to the fluid chamber. A return spring is provided by which the relative position of the piston relative to the fluid chamber is displaceable into a readiness position remote from the end position, and the return spring is arranged between the first and second abutment elements.

The furniture damper in that case has the above-described configuration. The spring which serves for the return movement of the relative position of the first and second abutment elements and which is arranged between the first and second abutment elements additionally serves to return the relative position of the piston relative to the fluid chamber. In that case, the spring disposed between the first and second abutment elements can support or completely replace a further return spring or springs serving to return the relative position of the piston relative to the fluid chamber.

In the last-mentioned case, the spring arranged between the first and second abutment elements must have a spring constant such that not only can the abutment elements be returned, but the relative position of the piston relative to the fluid chamber can also be returned to the readiness position after the conclusion of a damping process so that the furniture damper is ready for use for a fresh damping process. In that respect, the spring can be compressed substantially to the cross-sectional thickness of the spring by the relative movement of the first and second abutment elements.

The invention further concerns a furniture hinge having a furniture damper with a return spring as described above. In a particular embodiment, the furniture hinge has a carcass-side fitment portion and a hinge cup hingedly connected thereto for fixing furniture parts. In that case, in the mounted position the furniture damper is arranged substantially completely within the hinge cup or can be inserted from above into the hinge cup when the fitment portion and the hinge cup are already hingedly connected together, and it can be arranged within the hinge cup. The furniture damper can be connected to the hinge cup by way of co-operating fixing means in that mounted position.

BRIEF DESCRIPTION OF THE DRAWINGS

Further details and advantages of the present invention are described more fully hereinafter by means of the specific description with reference to the drawings, in which.

DETAILED DESCRIPTION OF THE INVENTION

Figure 1:
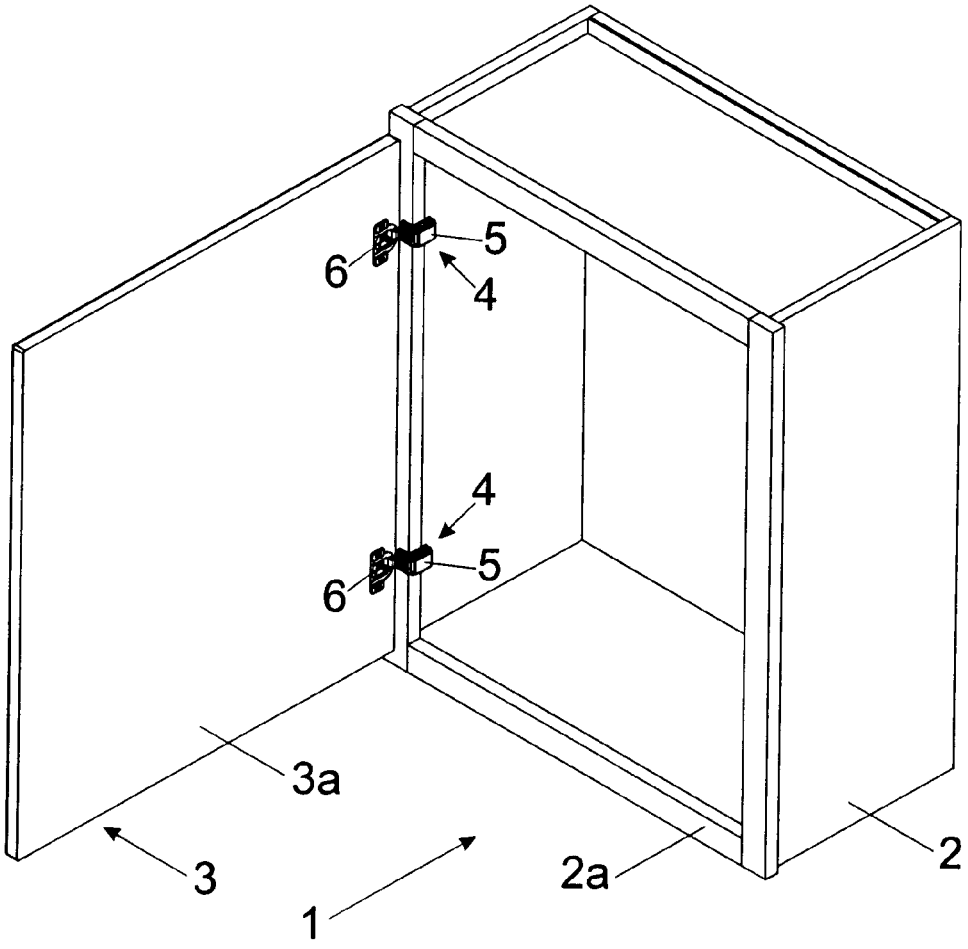
FIG. 1 shows a perspective view of an article of furniture with a door mounted pivotably relative to a furniture carcass by way of furniture hinges.

FIG. 1 shows a perspective view of an article of furniture 1, wherein a movable furniture part 3 in the form of a door 3*a* is mounted pivotably relative to a furniture carcass 2 by way of two or more furniture hinges 4. In a known manner, the furniture hinges 4 have a fitment portion 5 to be fixed to a frame 2*a* and a hinge cup 6 connected pivotably to the fitment portion 5. Mounted in the internal cavity in the hinge cup 6 is a respective furniture damper (not visible here), by which a closing movement of the furniture hinge 4 to the completely closed end position can be damped. Depending on the respective size and weight of the movable furniture part 3, the damping power of the furniture damper cannot be appropriately adapted. That is to say, in the case of a damping power which is excessively great, the movable furniture part 3 can pass into the completely closed position, either too slowly or not at all. For that reason, the damping action of the furniture damper can be completely deactivated by way of a locking device. In that respect, it may be desirable for example for the damping action of a first furniture hinge 4 to be completely deactivated while a second furniture hinge 4 provides an active damping action which permits a desired damped closing movement of the movable furniture part 3 to the completely closed position.

Figure 2A:
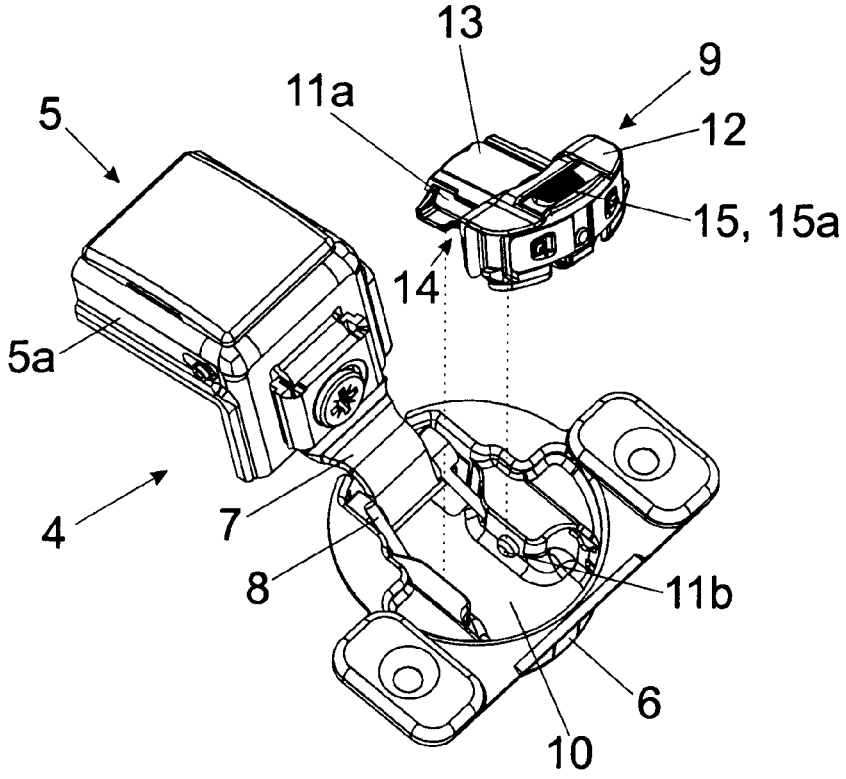
FIGS. 2*a* and 2*b* show perspective views of a furniture hinge with a furniture damper to be arranged in the hinge cup.

FIG. 2*a* shows a perspective view of a furniture hinge 4, wherein the hinge cup 6 is connected pivotably by way of at least one hinge lever 7 to the fitment portion 5 in the form of a hinge arm 5*a*. The furniture hinge 4 can be moved into the completely closed position and/or into the completely open position by way of a spring device 8. For damping that spring-assisted movement into the end position or positions, there is provided a furniture damper 9 having a housing 12 and a slider 13 movable relative thereto. The furniture damper 9 is either already fitted in the factory into the internal cavity 10 in the hinge cup 6 or alternatively—with the fitment portion 5 and the hinge cup 6 assembled—the furniture damper 9 can be retro-fitted from above into the hinge cup 6 and arranged within the hinge cup 6. In that case, the furniture damper 9 can be releasably connected together in that mounted position by way of a co-operating fixing device 11*a*, 11*b*. In the illustrated embodiment, the furniture damper 9 has first fixing part 11*a* in the form of a guide groove, which can be releasably connected to second fixing part 11*b* arranged in the hinge cup 6 and in the form of a fixing projection. The furniture damper 9 has an introduction opening 14 through which the fixing projection 11*b* can be arranged in the guide groove 11*a*. To deactivate the damping function, the furniture damper 9 has a locking device 15 with a displaceable arresting element 15*a* in the form of a switch member, by which the slider 13 can be releasably arrested in the position of being completely pressed in.

Figure 2B:
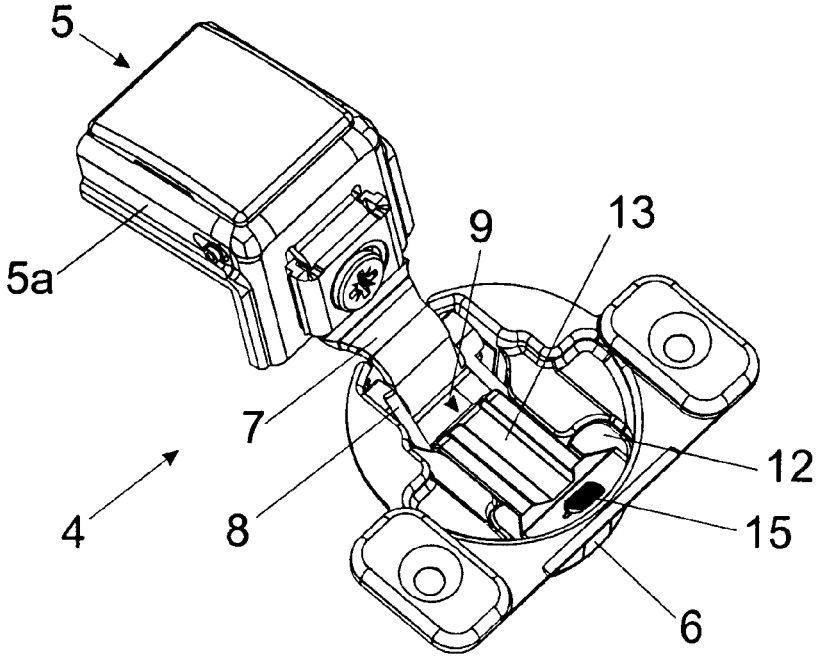

FIG. 2*b* shows a perspective view of the furniture hinge 4 with the furniture damper 9 in the mounted position. The furniture damper 9 is arranged completely in the internal cavity 10 in the hinge cup 6. In the closing movement of the furniture hinge 4, the hinge lever 7 encounters the slider 13, whereby the damping process is initiated. In the course of the further closing movement, the slider 13 can be pressed relative to the housing 12 into a complete end position, wherein that end position can be releasably arrested by the locking device 15. The slider 13 can no longer be returned in the arrested position, in which case therefore the damping action is deactivated.

Figure 3A:
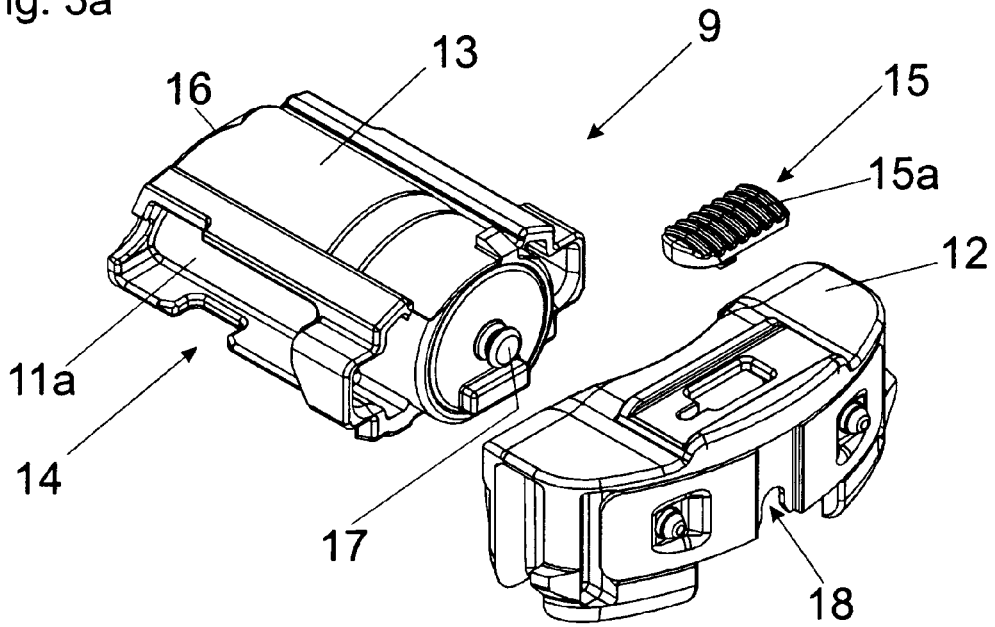
FIGS. 3*a* through 3*c* show the furniture damper as an exploded view, an enlarged detail view of the slider and the arresting element as a perspective view from below.

In the exploded view in FIG. 3*a*, the furniture damper 9 has a housing 12 and a slider 13 displaceable relative thereto. The furniture damper 9 is in the form of a linear damper and includes a piston rod 17 connected to the housing 12. This embodiment therefore provides that the piston rod 17 (and therewith a piston connected to the piston rod 17) is arranged stationarily in the mounted position while a fluid chamber provided in the slider 13 is movable relative to that stationary piston rod 17. The slider 13 is in the form of a sliding wedge member and has an inclined abutment surface 16 which, as from a predetermined relative position of the furniture hinge 4, can be acted upon by the hinge lever 7 (FIG. 2*b*).

Provided in the interior of the slider 13 is at least one fluid chamber in which at least one piston (not visible here) with a piston rod 17 is displaceably mounted. It is possible clearly to see the first fixing part 11*a* in the form of guide grooves on both sides, by which the slider 13 is displaceable in the damping stroke movement relative to the second fixing part (projections) 11*b* of the hinge cup 6. The second fixing part (projection) 11*b* can be arranged in the first fixing part (guide groove) 11*a* through the introduction opening 14. The housing 12 has a mounting 18 to which the piston rod 17 is to be fixed. Arranged on the slider 13 is a first securing element 19 which can be secured in the pressed-in end position of the slider 13 relative to a second securing element 20 arranged on the switch 15*a*.

Figure 3B:
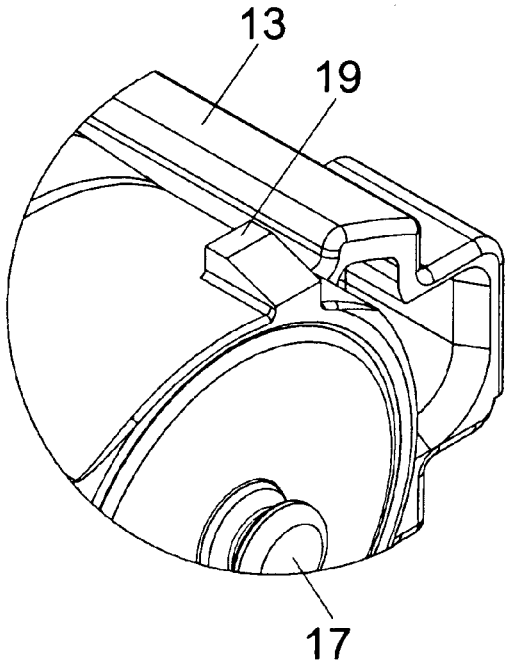
Figure 3C:
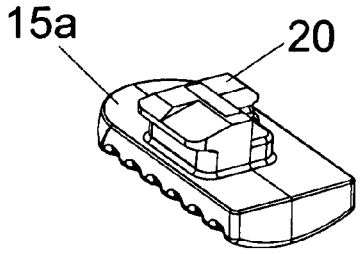

FIG. 3*b* shows an enlarged detail view of the slider 13, on which a first securing element 19 in the form of a resilient tongue is provided. FIG. 3*c* shows a perspective view from below of the arresting element 15*a* in the form of a switch. Arranged at the underside of the arresting element 15*a* is the second substantially rigid securing element 20, by which the first securing element 19 of the slider 13 can be secured in the completely pressed-in end position of the slider 13.

Figure 4A:
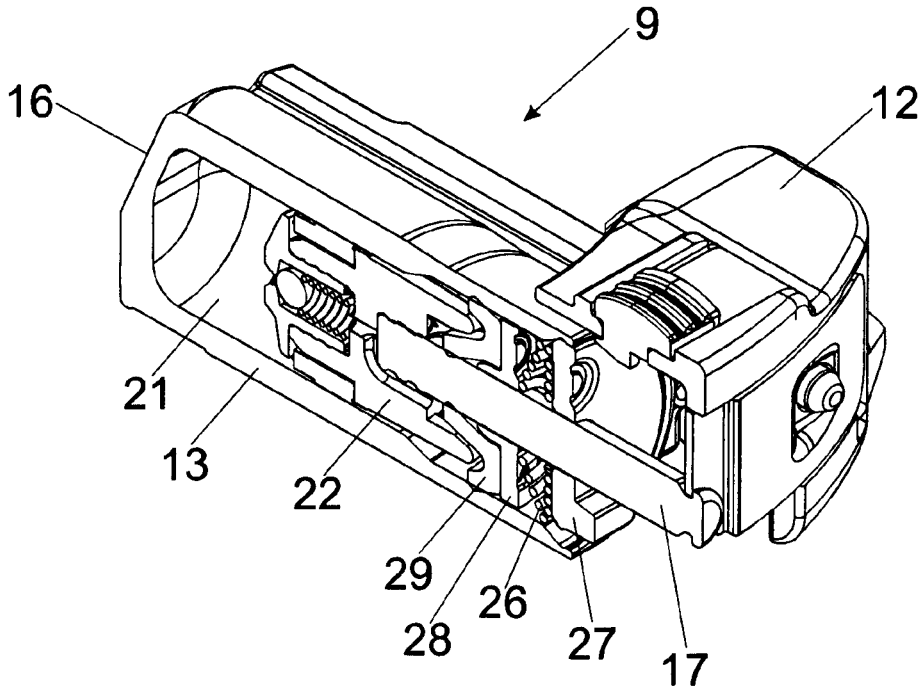
FIGS. 4*a* and 4*b* show perspective views in longitudinal section through the furniture damper in various positions of the piston relative to the fluid chamber.

FIG. 4*a* shows a perspective view in longitudinal cross-section through a furniture damper 9. It is possible to see the slider 13 in which there is a fluid chamber 21, in which a piston 22 with a piston rod 17 is mounted, being arranged stationarily in the illustrated embodiment. In the closing movement of the furniture hinge 4, the hinge lever 7 (FIG. 2*b*) encounters the inclined abutment surface 16 of the slider 13, whereupon the slider 13 is displaceable relative to the stationary piston 22.

The housing of the slider 13 has an open end which is closed by a first abutment element 27 in the form of a cover plate. The first abutment element 27 has an opening for the piston rod 17. The spring 26 in the form of a conical spiral spring is arranged around the piston rod 17. A first (large diameter) end of the spring 26 bears against the abutment surface of the first abutment element 27 and in that case is supported on the first abutment element 27. The narrower second (small diameter) end of the spring 26 bears against an abutment surface of a second abutment element 28 and is supported thereat. The second abutment element 28 has a sealing element 29 having an outer sealing lip 31 and an inner sealing lip 32. The outer sealing lip 31 serves to seal off the fluid chamber 21 in the region of the housing wall of the slider 13 and bears thereagainst. The inner sealing lip 32 serves to seal off the fluid chamber 21 in the region of the piston rod 17 and for that purpose bears thereagainst.

Figure 4B:
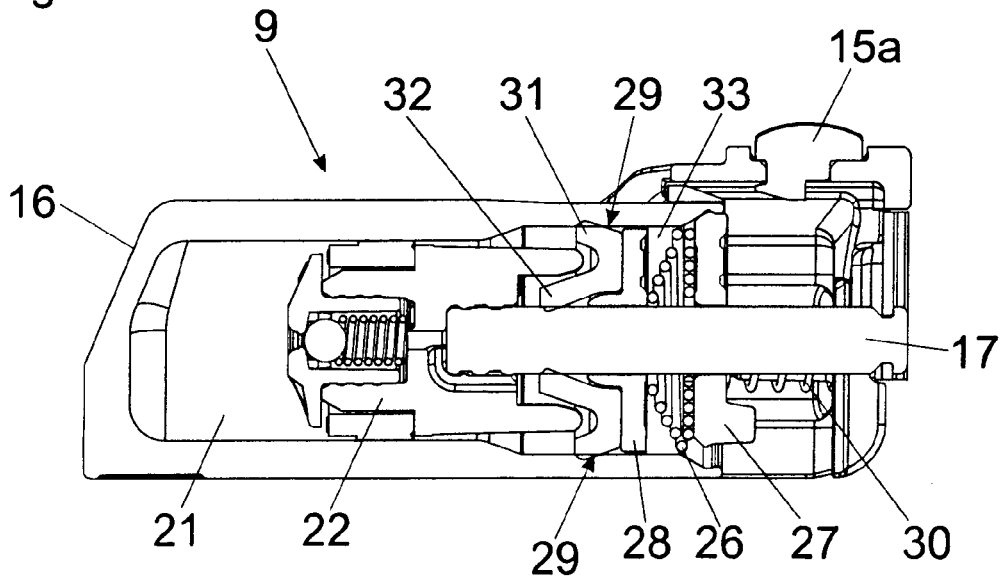

FIG. 4*b* shows a plan view of the longitudinal section in FIG. 4*a*, in which respect it is to be noted that the sealing lips 31 and 32 are shown diagrammatically. Without a piston rod 17 and without a wall of the slider 13, the sealing element 29 would assume the illustrated shape with the outer and inner sealing lips 31, 32. That is to say, the sealing element 29 it is of slightly larger outside dimensions than the space actually present within the fluid chamber 21. In the mounted position, by virtue of the elastic or deformable sealing element 29, the outer sealing lip 31 is pressed inwardly by the housing wall, while the inner sealing lip 32 is pressed outwardly by the piston rod 17. That permits mobility of the second abutment element 28 together with the sealing element 29 with simultaneous sealing of the fluid chamber 21 and the slider 13, respectively. In that case, the sealing element 29 can be fixed for example with adhesive on the second abutment element 28, or can be screwed thereto.

FIGS. 4*a* and 4*b* show the furniture damper 9 prior to initiation of a damping process by the hinge lever 7. The furniture damper 9 is in the readiness position. In that case, the fluid arranged in the region at the left of the piston 22 in the fluid chamber 21 is urged into the region to the right of the piston 22 by way of through openings, whereby a damping effect occurs. The sealing element 29 with the outer and inner sealing lips 31, 32 prevents the fluid from passing through into the additional compensating space 33 between the first and second abutment elements 27, 28. That additional compensating space 33 serves as an additional damping stroke and by way of the spring 26, permits a more gently matched damping action. The return spring 30 (which is not shown in FIG. 4*a* for reasons of clarity of the drawing) acts on the first abutment element 27 and serves to return the slider 13 again after damping has occurred.

Figure 5A:
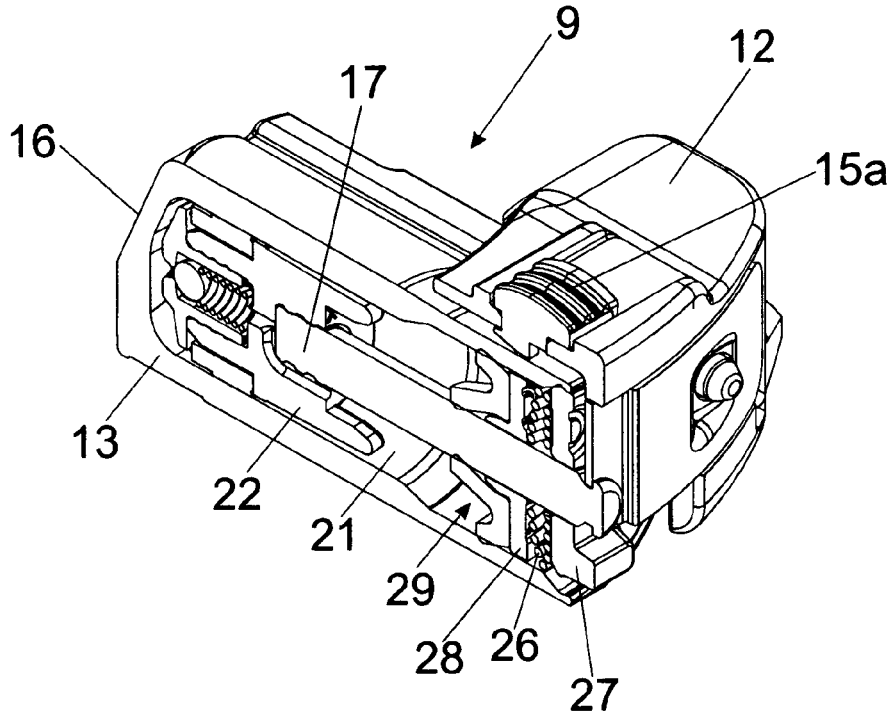
FIGS. 5*a* and 5*b* show the views of FIGS. 4*a* and 4*b* at another moment in time during the damping process.
Figure 5B:
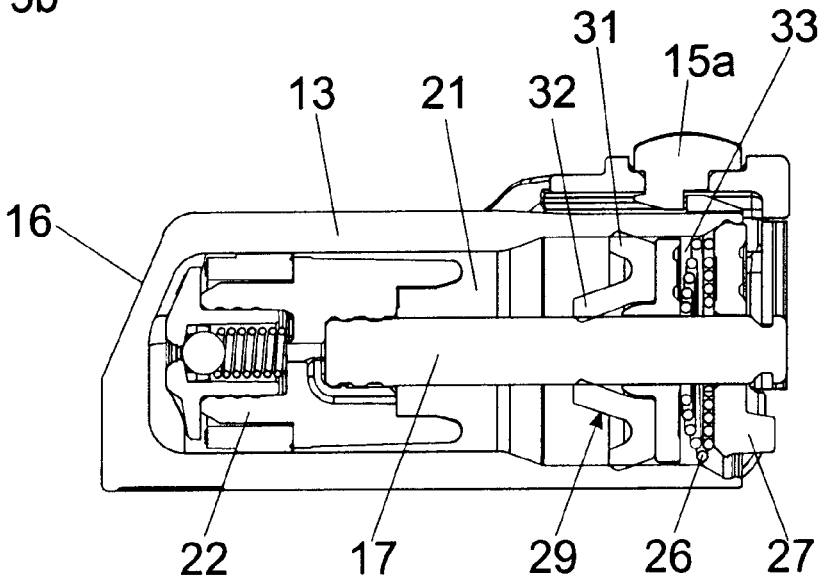

FIGS. 5*a* and 5*b* again show the furniture damper 9 as a perspective view (FIG. 5*a*) and a plan view (FIG. 5*b*) of a longitudinal section. The illustrated components correspond to those in FIGS. 4*a* and 4*b*. In the situation shown in FIGS. 5*a* and 5*b*, the slider 13 is almost in its end position with respect to the piston 22. The damping stroke which is possible by the piston 22 has been almost completely used up. Besides the damping stroke that is still available, the fluid in the fluid chamber 21, which fluid is moving with a certain inertia, is still additionally pressing in the direction of the sealing element 29. As can be seen, the additional compensating volume 33 of the additional compensating space 33 is also not yet entirely used up as the spring 26 can be compressed to its cross-sectional thickness (i.e., a thickness equal to the diameter of the wire forming the spring, as shown in FIG. 10*b*).

Figure 6A:
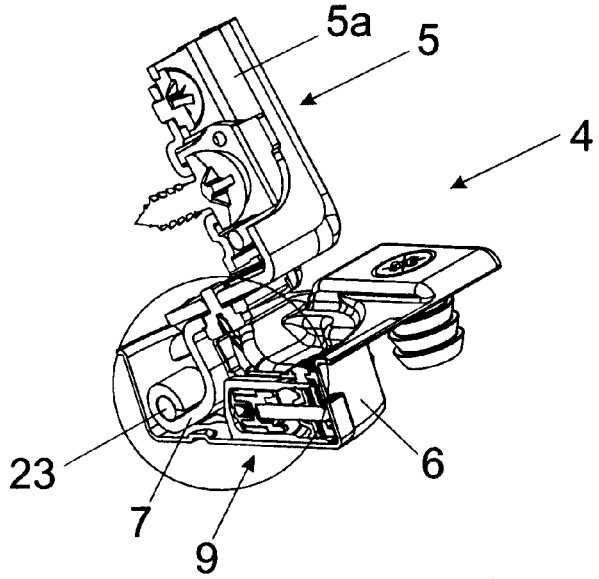
FIGS. 6*a* and 6*b* show a partly broken-away perspective view through a furniture hinge with a furniture damper integrated in the hinge cup, and a detail view thereof.
Figure 6B:
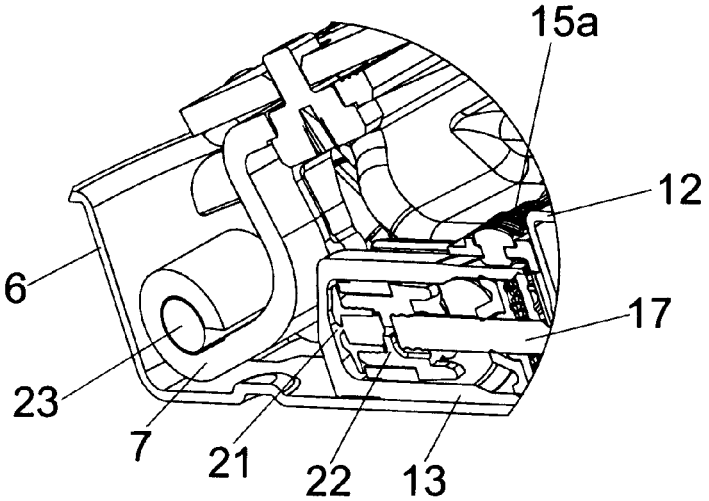

FIG. 6*a* shows a cross-section of a furniture hinge 4 with the furniture damper 9 in the mounted position. The furniture hinge 4 has a fitment portion 5 which is in the form of a hinge arm 5*a*—and which is preferably L-shaped—and which is connected pivotably to the hinge cup 6 by way of a hinge lever 7. The hinge lever 7 is mounted pivotably about an axis of rotation 23 at the furniture cup side. FIG. 6*b* shows an enlarged detail view of the region circled in FIG. 6*a*. Towards the end of the closing movement, the hinge lever 7 encounters the inclined abutment surface 16 of the slider 13 and displaces it relative to the stationary piston 22. The damping stroke of the furniture damper 9 extends substantially at a right angle to the axis of rotation 23. The slider 13 can be arrested by the switch 15*a* in the pressed-in end position relative to the housing 12 of the furniture damper 9, whereby the damping action can be deactivated.

Figure 7:
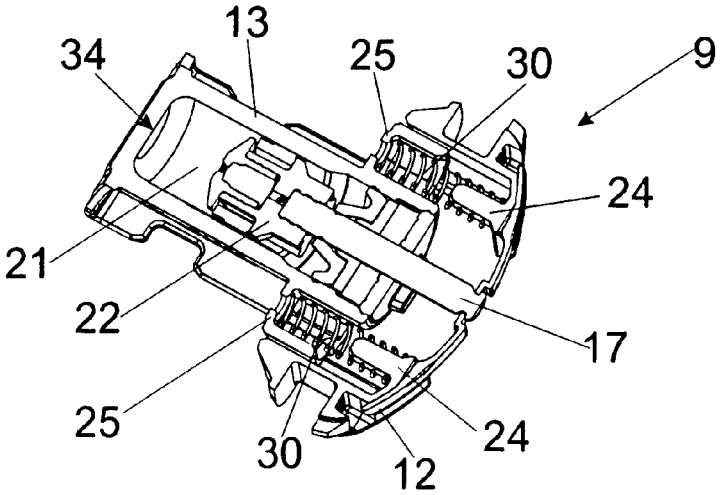
FIG. 7 shows a perspective view in longitudinal section of a furniture damper integrated in the hinge cup, and an enlarged detail view thereof.

FIG. 7 shows a longitudinal section of the furniture damper 9. The piston 22 with the piston rod 17 is mounted within the fluid chamber 21. It is possible to see a return mechanism 30 placed outside the fluid chamber 21 and in the form of two return springs which are supported on the one hand against abutments 24 of the housing 12 and on the other hand against counterpart abutments 25 of the slider 13. After the damping stroke has taken place, the slider 13 can be returned by the return mechanism 30 into a readiness position again, which is provided for the next damping stroke. It will be appreciated that it is also possible to arrange a return spring in the interior of the fluid chamber 21, which can be supported on the one hand against the end 34 of the fluid chamber 21 and on the other hand against the piston 22 and thus urges the piston 22 into the readiness position again.

Figure 8A:
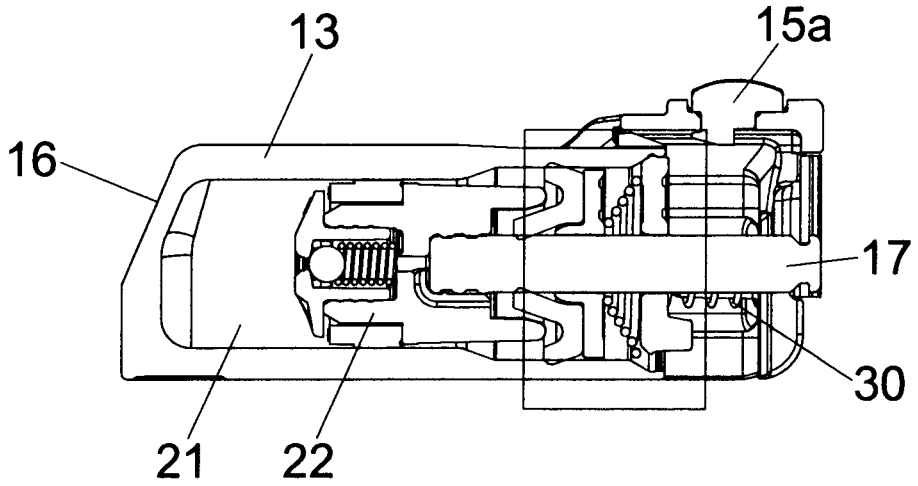
FIGS. 8*a* and 8*b* show a plan view of a longitudinal section through the furniture damper and an enlarged detail view thereof.

FIG. 8*a* corresponds in principle to FIG. 4*b*. The marked portion is shown as an enlarged view in FIG. 8*b*. The illustrated situation is prior to initiation of the damping process. The additional compensating space 33 is still completely unused. The spring is in its neutral (free) position or in the starting position defined by the abutment elements 27, 28, and is not yet compressed by a relative movement of the abutment elements 27, 28.

Figure 8B:
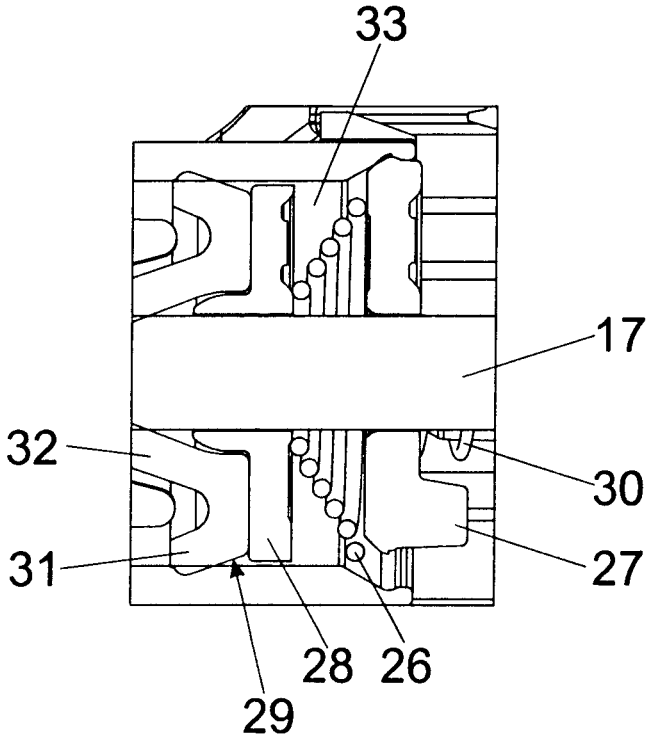
Figure 9A:
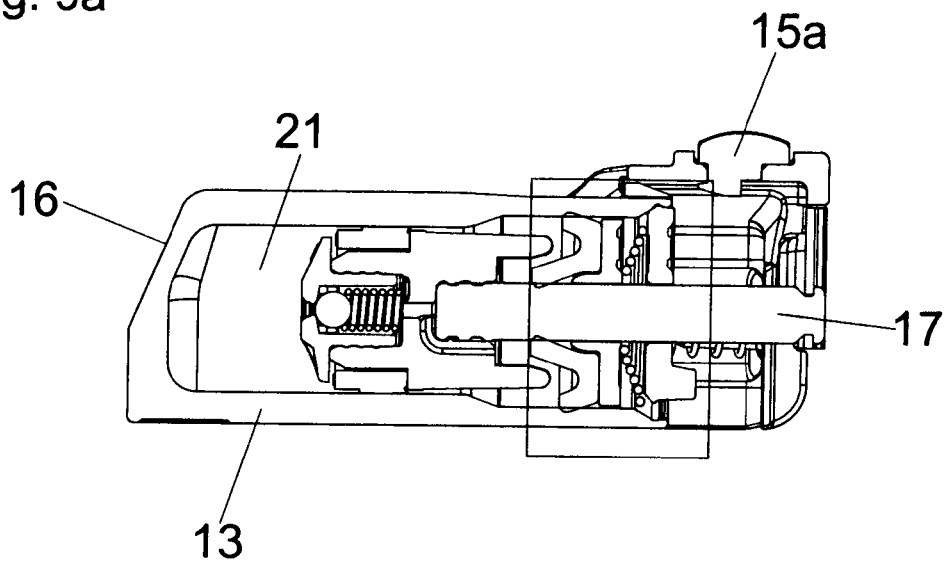
FIGS. 9*a* and 9*b* show the views of FIGS. 8*a* and 8*b* at another moment during the damping process.
Figure 9B:
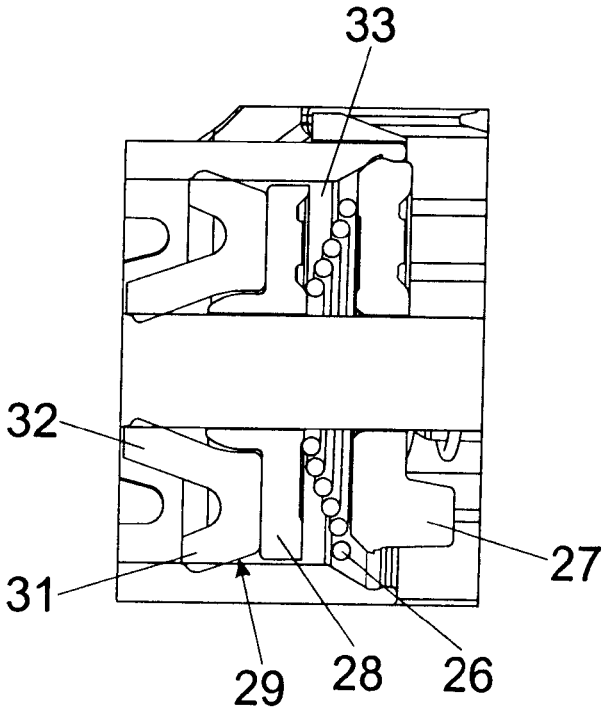

FIGS. 9*a* and 9*b* show the components of FIGS. 8*a* and 8*b*, wherein the damping process is already further advanced. The spring 26 is already compressed and the additional compensating space 33 is partially used up by the second abutment element 28 which is moving towards the first abutment element 27.

Figure 10A:
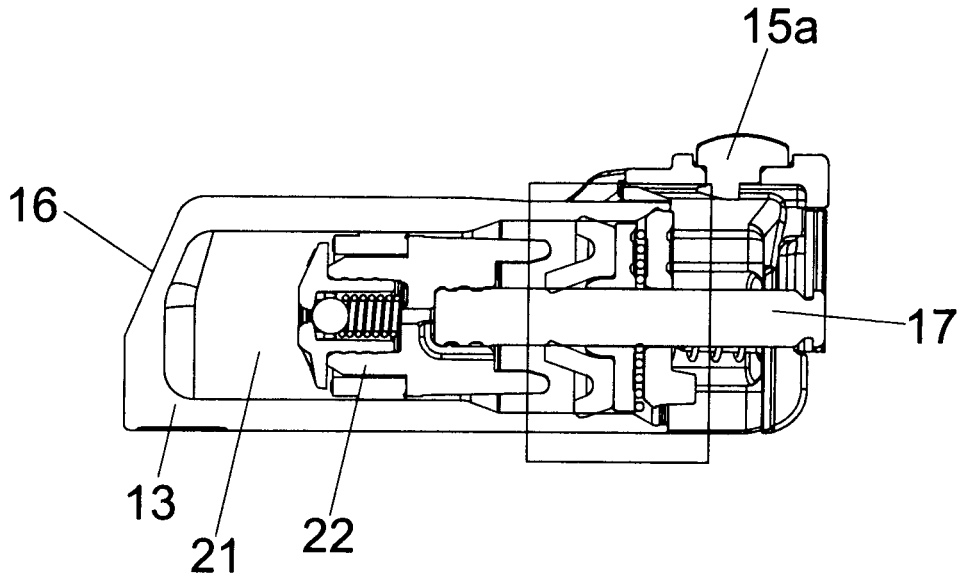
FIGS. 10*a* and 10*b* show the views of FIGS. 8*a* and 8*b* at yet another moment during the damping process.
Figure 10B:
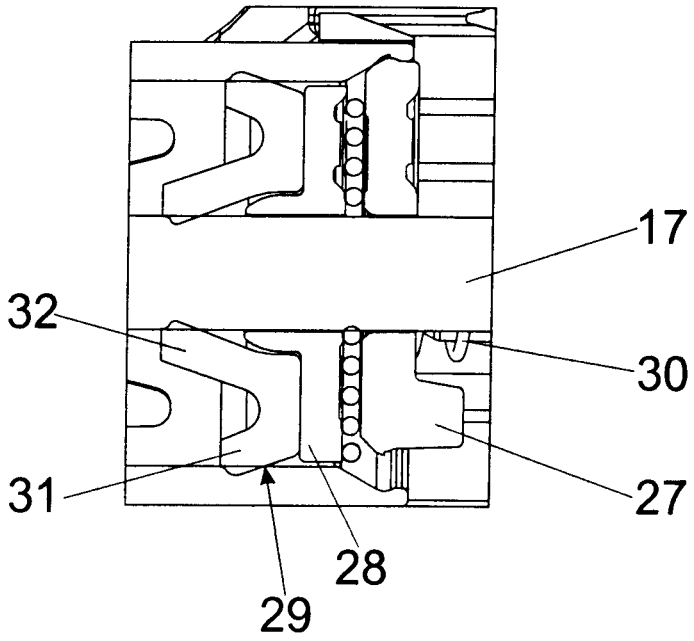

FIGS. 10*a* and 10*b* show the components of FIGS. 8*a* and 8*b*, wherein the damping process is now concluded and the first abutment element 27 and the second abutment element 28 are in their end position, that is to say at the smallest spacing relative to each other. The spring 28 is now compressed completely to the cross-sectional thickness of the spring 26 or the spring coil (i.e., compressed to a thickness equal to a diameter of the wire forming the spring). That provides a maximum damping stroke movement, and the internal space in the slider 13 can be small with nonetheless a sufficient damping stroke. That is of great advantage in particular when it is arranged within a hinge cup.

Figure 11A:
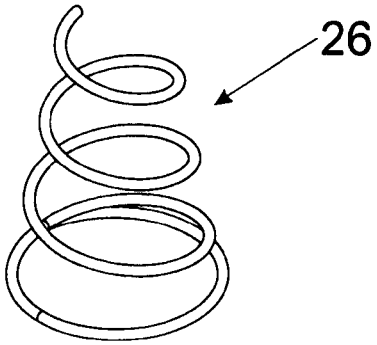
FIGS. 11*a* through 11*e* show various views of a conical spiral spring according to the invention.
Figure 11B:
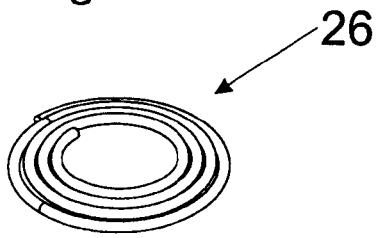

FIGS. 11*a* and 11*b* show the spring 26 in the form of a conical spiral spring as perspective views in its neutral position (FIG. 11*a*) and in the compressed position (FIG. 11*b*) where it can be seen that the spring 26 can be compressed to the form of a spiral so that the compressed spring 26 is substantially of its cross-sectional thickness.

Figure 11C:
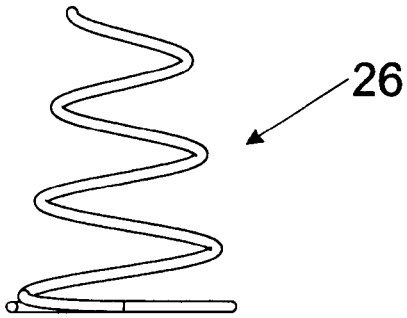
Figure 11D:
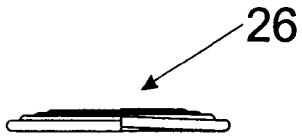

That can also be clearly seen from the side view in FIG. 11*d*. In comparison, the side view of the spring 26 in FIG. 11*c* shows the spring in its neutral position.

Figure 11E:
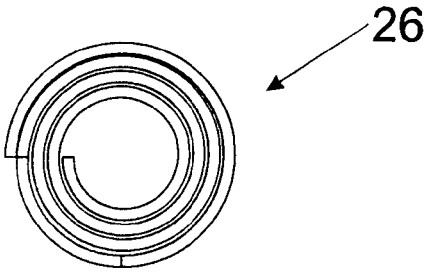

FIG. 11*e* again shows a plan view of the spring 26 where it can be seen that the projection of the spring 26 on to a plane perpendicular to the longitudinal axis is in the form of a spiral, independently of the compression condition. It will be seen that the spring coils of the spring are of such a configuration that they can be pushed one into the other.

In the illustrated drawings, the return of the slider 13 is implemented by way of return springs 30. It is, however, also possible to permit that return movement by the spring 26, in which case the spring 26 can support or entirely replace the return springs 30.

The present invention is not limited to the illustrated embodiment but extends to all variants and technical equivalents which can fall within the scope of the appended claims. The positional references adopted in the description such as for example up, lateral, and so forth are also related to the directly described Figure and are to be appropriately transferred to the new position upon a change in position.

The invention claimed is:

1. A furniture hinge comprising:

a furniture damper for damping a movement of a movably mounted furniture part or a movably mounted furniture fitting component of a furniture fitting, said furniture damper including:

a fluid chamber;

a piston arranged in said fluid chamber such that a damping action is performed by a relative movement between said fluid chamber and said piston;

a sealing device for sealing said fluid chamber, said sealing device having a first abutment element and a second abutment element mounted movably relative to said first abutment element and being configured to seal said fluid chamber, said second abutment element being mounted movably relative to said piston; and a spring between said first abutment element and said second abutment element, said spring being compressible by a relative movement between said first abutment element and said second abutment element to a cross-sectional thickness of said spring equal to a diameter of a wire forming said spring;

a carcass-side fitment portion; and a hinge cup hingedly connected to said fitment portion for fixing furniture parts to each other, wherein said furniture damper, said fitment portion, and said hinge cup are configured such that said furniture damper is arranged substantially completely within said hinge cup in a mounted position.

2. The furniture hinge as set forth in claim 1, wherein said spring is a conical spiral spring.

3. The furniture hinge as set forth in claim 1, wherein said spring has a central opening in which said piston or a piston rod connected to said piston is arranged.

4. The furniture hinge as set forth in claim 1, wherein said first abutment element has a contact surface against which a first end of said spring bears in the mounted condition of said spring.

5. The furniture hinge as set forth in claim 1, wherein said fluid chamber has an open end, and said first abutment element is formed as a cover plate for closing off the open end of said fluid chamber.

6. The furniture hinge as set forth in claim 1, wherein said second abutment element has a contact surface against which a second end of said spring bears in the mounted condition of said spring.

7. The furniture hinge as set forth in claim 6, wherein said first abutment element has a contact surface against which a first end of said spring bears in the mounted condition of said spring.

8. The furniture hinge as set forth in claim 1, wherein said second abutment element has a sealing element with sealing lips which bear against said piston or a piston rod connected to said piston or against said housing wall of said fluid chamber.

9. The furniture hinge as set forth in claim 1, wherein said piston assumes an end position at an end of a damping stroke relative to said fluid chamber, and a position of said piston relative to said fluid chamber is displaceable by said spring into a readiness position remote from said end position.

10. The furniture hinge as set forth in claim 1, wherein said furniture damper, said fitment portion, and said hinge cup are configured such that, when said fitment portion and said hinge cup are hingedly connected together, said furniture damper is inserted into said hinge cup and arranged within said hinge cup, said furniture damper being connected to said hinge cup by a co-operating fixing device.

11. The furniture hinge as set forth in claim 10, wherein said fixing device includes:

a first fixing part formed as a guide groove on said furniture damper; and a second fixing part formed as a projection on said hinge cup, said projection engaging said guide groove when said furniture damper is mounted within said hinge cup.

12. The furniture hinge as set forth in claim 1, wherein said furniture damper further includes a housing and a slider movable relative to said housing, wherein said fluid chamber, said piston, said sealing device, and said spring are accommodated within at least one of said housing and said slider, at least one of said housing and said slider being configured to releasably mount said furniture damper within a hinge cup of a furniture hinge.

13. The furniture hinge as set forth in claim 1, wherein said furniture damper further includes a fixing device for releasably mounting said furniture damper within a hinge cup of a furniture hinge.

14. The furniture hinge as set forth in claim 1, wherein said furniture damper is configured to assume an end position at an end of a damping stroke relative to said hinge cup, said furniture damper further including a return spring for returning said furniture damper to a readiness position remote from said end position.

15. The furniture hinge as set forth in claim 14, wherein said return spring is located outside said fluid chamber of said furniture damper.

16. The furniture hinge as set forth in claim 14, wherein said return spring comprises a pair of return springs located outside said fluid chamber of said furniture damper, said return springs being symmetrically located at opposite sides of said piston.

* * * * *